United States Patent [19]

Clarke

[11] 4,283,294

[45] Aug. 11, 1981

[54] LUBRICATING OIL COMPOSITION

[75] Inventor: Christopher T. Clarke, Oxford, England

[73] Assignee: Exxon Research & Engineering Co., Florham Park, N.J.

[21] Appl. No.: 84,364

[22] Filed: Oct. 12, 1979

[30] Foreign Application Priority Data

Oct. 13, 1978 [GB] United Kingdom ..... 40427/78

[51] Int. Cl.[3] ..... C10M 1/48

[52] U.S. Cl. ..... 252/32.7 R; 252/33; 252/33.2; 252/42.7

[58] Field of Search ..... 252/32.7, 33, 33.2, 252/42.7

[56] References Cited

U.S. PATENT DOCUMENTS

| | | | |
|---|---|---|---|
| 2,943,052 | 6/1960 | Carlyle et al. | 252/33 |
| 3,001,940 | 9/1961 | Walson et al. | 252/33 |
| 3,907,691 | 9/1975 | King et al. | 252/33 |
| 4,123,369 | 10/1978 | Miller et al. | 252/33 |

FOREIGN PATENT DOCUMENTS

| | | |
|---|---|---|
| 0729367 | 6/1955 | United Kingdom . |
| 0774683 | 3/1957 | United Kingdom . |
| 0942626 | 10/1963 | United Kingdom . |
| 1054276 | 4/1967 | United Kingdom . |
| 1065595 | 5/1967 | United Kingdom . |
| 1189338 | 9/1970 | United Kingdom . |

*Primary Examiner*—Winston A. Douglas
*Assistant Examiner*—J. V. Howard
*Attorney, Agent, or Firm*—Eugene Zagarella, Jr.

[57] ABSTRACT

Lubricating oil compositions suitable for use in marine diesel engines comprise 60 to 85 parts by weight of lubricating oil, 15 to 30 parts by weight of a mixture of more than 50 wt .% of a Group IIa metal overbased detergent and up to 50 wt .% of a Group Ia metal overbased detergent and 0.2 to 5 parts by weight of an antioxidant, provided the weight ratio of the overbased detergent mixture to antioxidant lies between 7.5:1 and 50:1, all parts by weight referring to total active matter of the additive. When used in loop-scavenged crosshead marine diesel engines fouling of air ports with deposits is considerably reduced and there is a satisfactory antiwear performance.

13 Claims, No Drawings

LUBRICATING OIL COMPOSITION

This invention relates to lubricating oil compositions which are used in low speed crosshead diesel engines, normally used for marine propulsion.

Scavenge air ports in loop-scavenged crosshead marine diesel engines are prone to build up deposit. This can result in reduced maintenance overhaul intervals and reduced efficiency of engine operation, by interfering with the normal respiration of the engine.

We have now discovered an oil composition which when used in loop-scavenged crosshead marine diesel engines assists considerably in reducing fouling of the air ports with deposits and which also displays satisfactory antiwear performance.

According to this invention a lubricating oil composition suitable for use in marine diesel engines comprises 60 to 85 parts by weight of lubricating oil, 15 to 30 parts by weight of a mixture of more than 50 wt.% of a Group IIa metal overbased detergent and up to 50 wt.% of a Group Ia metal overbased detergent (as hereinafter defined) and 0.2 to 5 parts by weight of an antioxidant, provided the weight ratio of the overbased detergent mixture to anioxidant lies between 7.5:1 and 50:1, all parts by weight referring to total active matter of the additive.

The lubricating oil which is used may be an animal, vegetable or mineral oil or a synthetic oil and is preferably a hydrocarbon oil. The mineral oils are preferably substantially paraffinic and/or naphthenic in character. However, they may contain a substantial proportion of hydrocarbons having an aromatic character, up to about 25%. The viscosity may vary considerably, e.g. ranging from SAE30 to 50, but is normally SAE 50. Suitable oils may be derived from highly paraffinic crude oils in which case distillation and/or dewaxing may be sufficient to provide a suitable base stock. Mixed base crudes and even highly aromatic crudes which contain paraffinic hydrocarbons may also be used after suitable refining procedures. The mineral oil bases may be blends of distillate lubricating oils and bright stocks.

The mineral oils may be mixed with or replaced by synthetic lubricants or polymerised olefins, for example polyisobutylene. Suitable synthetic lubricants include diesters such as di-octyl adipate, di-octyl sebacate, didecyl azelate, tridecyl adipate, didecyl succinate, didecyl glutarate and mixtures thereof. Alternatively the synthetic ester can be a polyester such as that prepared by reacting polyhydric alcohols such as trimethylol propane and pentaerythritol with monocarboxylic acids such as butyric acid to give the corresponding tri- and tetraesters. Also complex esters may be used, such as those formed by esterification reactions between a carboxylic acid, a glycol and an alcohol or a monocarboxylic acid.

The overbased detergent is defined as a salt or complex wherein the amount of metal cation is in excess of stoichiometric compared with the oil-soluble anion. Usually this excess is obtained by treating the reaction mixture for the preparation of the additive with an acidic gas such as carbon dioxide or hydrogen sulphide, when the final product contains a colloidal dispersion in oil of the metal salt derived from the metal and acidic gas, e.g. a carbonate, or sulphide.

Suitable overbased detergent additives include overbased phenates or phenol sulphides, overbased phosphosulphurised polyolefins, overbased organic sulphonates and overbased naphthenates.

Suitable phenates include the Group Ia and Group IIa metal phenates. The alkyl phenate can be prepared by reacting an alkyl phenol e.g. octyl, nonyl, n-decyl, cetyl or dioctyl phenol with an alkali metal base, or an alkaline earth metal base e.g. barium hydroxide octahydrate. To make the corresponding overbased phenate, the phenol is reacted with excess base, and the excess neutralised with an acidic gas, e.g. carbon dioxide. Overbased phenates also having a TBN (total base number, ASTM D 664) of 175 to 500 are suitable.

Instead of using a phenate the corresponding sulphurised phenate may be used. Such phenates can be prepared by reacting the alkyl phenate with elemental sulphur or sulphur dichloride to give a complex reaction product, free alkyl phenol or volatile material in the reaction product preferably being removed by steam distillation.

Other overbased detergent additives include overbased Group Ia and IIa metal salts of long chain mono- or di-carboxylic acids, e.g. those wherein the acid radical contains at least 50 carbon atoms per molecule. Thus one may use for example metal salts, e.g. calcium or barium, of long chain succinic acids, e.g. those having a molecular weight of 850 to 1200. In order to obtain the high alkalinity, the metal salt reaction mixture can be treated with carbon dioxide, usually in the presence of a promoter such as alkyl phenol or an alcohol.

Other suitable overbased detergent additives include products prepared by reacting a base of a Group Ia or IIa metal (alkali metal or alkaline earth metal) with a phosphosulphurised hydrocarbon and an alkyl phenol or an alkyl phenol sulphide in the presence of a diluent oil, carbon dioxide being blown into the reaction mixture whilst the reaction takes place. Alternatively, the already prepared alkali metal or alkaline earth metal alkyl phenate or alkyl thiophenate can be used as a starting material. Methods of preparing such products as described in U.K. Patent Specification Nos. 921,124, 940,175, 958,520, 970,786, 867,800 and 887,334. The calcium, barium or sodium salts are preferred.

Another suitable overbased detergent additive is an overbased Group Ia or IIa metal (alkali metal or alkaline earth metal) salicylate, e.g. an overbased calcium salicylate. These may be made by reacting an oil soluble metal salt, e.g. calcium salt, of an alkyl salicylic acid in the presence of oil and a water-miscible oxygen-containing organic solvent, e.g. an alcohol, glycol or ketone, with a polyvalent metal carbonate, which is formed in situ in the reaction mixture. The in situ formation of the polyvalent metal carbonate may be carried out by the reaction of a polyvalent base such as an oxide, hydroxide or alkoxide with carbon dioxide passed into the reaction mixture.

Organic sulphonates can be obtained from the sulphonic acids derived from sulphonating natural hydrocarbons or synthetic hydrocarbons. Such sulphonic acids are obtained by treating lubricating oil base stocks with concentrated or fuming sulphuric acid to produce oil soluble "mahogany" acids or by sulphonating alkylated aromatic hydrocarbons. Particularly useful are the products derived from the alkylation of aromatic hydrocarbons with olefins or olefin polymers, e.g. $C_{15}$–$C_{30}$ polypropenes or polybutenes.

The sulphonic acids can contain more than one sulphonic acid group in the molecule. The preferred sulphonic acids have molecular weights of from 300 to 1000. The sulphonates are the alkaline earth metal sulphonates, usually the calcium, barium or magnesium sulphonates or alkali metal sulphonates, e.g. sodium phosphonates.

The overbased sulphonates are high alkalinity sulphonates which contain metal base in excess of that required for simple neutralisation of the sulphonic acids to the normal metal sulphonates. In preparing the overbased sulphonates, the sulphonic acids are reacted with an excess of metal base and the excess base is usually neutralised with an acidic gas, e.g. carbon dioxide, preferably in the presence of a promoter, e.g. an alkyl phenol or an alcohol such as methanol or propanol. The preferred overbased sulphonates have a TBN of from 175 to 500. Thus specific examples are overbased synthetic calcium hydrocarbon sulphonates of about 300 TBN with a molecular weight of 400 to 500: a calcium salt of sulphonated bottoms from a $C_{12}$ alkyl benzene overbased to a TBN of 230 to 270; and a barium $C_{16}$ alkylbenzene sulphonate overbased to a TBN of 280 to 300. A suitable method of making an overbased sulphonate is described in the specification of our UK Patent Specification 1,299,253.

Overbased naphthenates can be made by reacting an alkyl phenol with a naphthenic acid and an excess of an alkaline earth metal base, the excess base being neutralised with carbon dioxide.

In general to a be suitable for use in the lubricating oil composition of this invention, the overbased detergent should have a TBN (ASTM D664) of between 175 and 500, preferably between 200 and 400.

Although the overbased detergent may be derived from any Group Ia and IIa metal, it is usually derived from calcium and sodium. The use of alkali metal (e.g. sodium) detergents enhances the storage and thermal stability of the composition and also gives better corrosive protection than alkaline earth metal detergents. However, the presence of alkaline earth metal detergents is essential to ensure good antiwear performance.

Although up to 50 wt.% of a Group Ia metal can be used in practice it is preferred that the overbased detergent comprises more than 80 wt.% of Group IIa metal detergent, e.g. calcium, and up to 20 wt.% of Group Ia metal detergent, e.g. sodium.

The other component of the lubricating oil composition is an antioxidant. Antioxidants are compounds which retard or inhibit oxidation and in this case they must be oil-soluble and at least retard the oxidation of the lubrication oil composition, and show good thermal stability in the finished blend.

Examples of suitable antioxidants are alkylated phenols, organic amines, organic sulphur compounds and metal thiophosphates.

Suitable organic sulphur compounds include sulphides, for example nonyl phenyl sulphide, dibenzyl sulphide or phosphosulphurised 2-pinene.

Suitable alkylated phenols include tri alkylated phenols such as 1-hydroxy, 2,4,6 tri-methyl benzene, di-t-butyl para cresol and 1-naphthol.

Preferred phenols however are the hindered phenols, i.e. phenols substituted at positions adjacent to the hydroxy group, for example, 2,4,6 tri-t-butyl phenol; 2,6 di-t-butyl phenol; 2,6 di-t-butyl 4-methyl phenol and 2,2-bis(3',5' di-t-butyl 4' hydroxy phenyl)pentane.

Suitable amine antioxidants include diarylamines, e.g. diphenylamine, phenyl-$\alpha$-naphthylamine and phenyl-$\beta$-naphthylamine, and thiodiarylamines, e.g. phenothiazine, the alkylated phenothiazines and phenyl thionaphthylamine.

Metal thiophosphates which may be used include zinc dialkyl dithio phosphates (ZDDPs), especially those where the alkyl groups are amyl and/or butyl, or diaryl.

The lubricating oil, overbased detergent and antioxidant have to be blended in certain proportions in order to meet the requirements of this invention. The quantities for the detergent and antioxidant and any other additive specified throughout this specification refer to the total active matter and any oil present in the additives has to be included with the base oil in assessing how much oil is present in the lubricating oil composition. Thus, usually most detergent additives are 60 to 70 wt.% active matter and this means in practice that when choosing for example 15 parts by weight of overbased detergent one will have to add about 22 to 23 parts by weight of the commercially available additive to the base oil.

The more overbased detergent which is present in the lubricating oil composition the higher the TBN of the final product. Thus, as a rough guide with 1 to 2 wt.% of antioxidant 16 wt.% of detergent produces a TBN of about 70 and 23 wt.% of detergent produces a TBN of about 100, the TBN of the overbased detergent itself being about 300. For an overbased detergent of 250 TBN, the corresponding proportions are about 20 wt.% to give 70 TBN and 28 wt.% to give 100 TBN.

In general it is preferred that there be 75 to 85 parts by weight of lubricating oil 15 to 25 parts by weight of overbased detergent mixture and 0.5 to 2.5 parts by weight of antioxidant, also with the proviso that the weight ratio of overbased detergent mixture to antioxidant lies between 7.5:1 and 50:1, also it is preferred that said weight ratio lies between 20:1 and 30:1.

If desired a small amount e.g. 0.01 to 5.0 wt.%, of a dispersant, e.g. a polyisobutenyl succinic anhydride-tetraethylene pentamine reaction product; or an antiwear agent, e.g. a primary amine salt of the dithiophosphoric acid produced by reaction of $P_2S_5$ and catechol; or auxiliary surfactant e.g. polyisobutenyl succinic anhydride/nonyl phenol; or a lubricity agent may be added.

EXAMPLE 1

A lubricating oil composition in accordance with the invention was prepared by blending 73.2 parts by weight of a base lubricating oil, Necton 78 (which is a hydrocarbon mineral lubricating oil made from a naphthenic crude and having a viscosity of 13–68 cSt at 100° C., and a viscosity index of 66), 20.8 parts by weight of a 240 TBN calcium overbased sulphurised phenate, (containing about 70 wt.% active ingredient) 5.0 parts by weight of a 400 TBN sodium overbased reaction product of polyisobutene, $P_2S_5$, alkyl phenol and $CO_2$ (containing about 60 wt.% active ingredient), and as the antioxidant, 1.0 part by weight of a nonyl phenyl sulphide (containing about 80 wt.% active ingredient). (Formulation I).

The physical properties and antiwear and antioxidant properties of I are compared to a commercially available calcium overbased oil of high detergency in Table I.

The shipboard anti-port fouling performance of I is compared to the same commercial reference oil in Table II by a scavenge air port plugging test.

Marine two stroke cycle crosshead engines admit scavenge air into each cylinder for combustion and cooling through several (typically 14) holes or ports in the lower cylinder liner wall. Exhaust gases pass from the cylinder either through a similar set of ports in the lower cylinder wall (loop and cross scavenge engines) or through an exhaust valve in the cylinder cover (uni-flow scavenge engines).

The scavenge air ports particularly of loop scavenge engines may become partially obstructed by residues formed of oil, and combustion and wear debris, during engine operation. In extreme cases a port may become completely closed. Obstruction of the free air passage through any of the scavenge air ports can lead to inefficient combustion in that cylinder.

Scavenge air port plugging is assessed at engine inspection approximately every 1000 to 2000 hours by considering the percentage area of obstruction of each scavenge air port and reducing those values to a single average figure per cylinder.

EXAMPLE 2

A second lubricating oil composition in accordance with the invention was prepared by blending 67.2 parts by weight of a base lubricating oil, Necton 78 (which is described in Example 1), 5.0 parts by weight of a base lubricating oil, Necton 60 (which is a hydrocarbon mineral lubricating oil made from a naphthenic crude, having a viscosity of 9.65 cSt at 100° C. and a viscosity index of 70), 20.8 parts by weight of a 240 TBN calcium overbased sulphurised phenate (as described above), 5.0 parts by weight of the 400 TBN sodium overbased reaction product of polyisobutene, $P_2S_5$, alkyl phenol and $CO_2$ described above and as the antioxidant 2.0 parts by weight of a zinc dialkyldithiophosphate (containing about 70 wt.% of active ingredient) (Formulation II).

The physical and antioxidant properties, and antiwear performance of II are compared to the commercial reference oil in Table I.

EXAMPLE 3

A third lubricating oil composition in accordance with the invention was prepared by blending 67.2 parts by weight of a base lubricating oil, Necton 78 (which is described in Example 1), 5.0 parts by weight of a base lubricating oil, Necton 60 (which is described in Example 2), 20.8 parts by weight of a 240 TBN calcium overbased sulphurised phenate (as described above), 5.0 parts by weight of the 400 TBN sodium overbased reaction product of polyisobutene, $P_2S_5$, alkyl phenol and $CO_2$ described above and as the antioxidant 2.0 parts by weight of a nonyl phenyl sulphide, (which is described in Example 1). (Formulation III).

The physical and antioxidant properties and antiwear performance of III are compared to the commercial reference oil in Table 1.

EXAMPLE 4

A fourth lubricating oil composition in accordance with the invention was prepared by blending 67.2 parts by weight of a base lubricating oil, Necton 78 (which is described in Example 1), 5.0 parts by weight of a base lubricating oil, Necton 60 (which is described in Example 2), 20.8 parts by weight of a 240 TBN calcium overbased sulphurised phenate (as described above), 5.0 parts by weight of the 400 TBN sodium overbased reaction product of polyisobutene, $P_2S_5$, alkyl phenol and $CO_2$ described above and as the antioxidant 1.0 part by weight of a zinc dialkyldithiophosphate (containing about 70 wt.% of active ingredient) and 1.0 part by weight of a nonyl phenol sulphide (which is described in Example 1). Formulation IV).

The physical and antioxidant properties and antiwear performance of IV are compared to the commercial reference oil in Table I.

TABLE I

| | Reference Oil | Example 1 Composition | Example 2 Composition | Example 3 Composition | Example 4 Composition |
|---|---|---|---|---|---|
| TBN | 70 | 70 | 70 | 70 | 70 |
| Viscosity (cSt at 100° C.) | 16.6 | 16.8 | 17.3 | 16.8 | 16.9 |
| Viscosity index | 69 | 70 | 74 | 74 | 74 |
| Relative piston ring wear rate | 1.00 | 1.00 | 1.08 | — | — |
| Oxidation life (hours) | 45 | 85 | 60 | 95 | 70 |
| Modified Panel Coker Deposit Test, Merit at 24 hours | 7.0 | 7.5 | 7.0 | 7.5 | 7.0 |

(10 = best)

TABLE II

| | Average Percent Port Blockage at Inspection | Engine Operating Hours |
|---|---|---|
| Reference OIl | 44 | 5510 |
| Example I Composition | 7 | 2140 |

What is claimed is:

1. A lubricating oil composition comprising 60 to 85 parts by weight of lubricating oil, 0.2 to 5 parts by weight of an antioxidant and 15 to 30 parts by weight of a mixture of more than 50 wt.% of group IIa metal overbased detergent and up to 50 wt.% of a Group Ia metal overbased detergent, provided the weight ratio of the overbased detergent mixture to antioxidant lies between 7.5:1 and 50:1, all parts by weight referring to the total active matter of the additive.

2. A composition according to claim 1 wherein the overbased detergent mixture has a TBN of between 175 and 500.

3. A composition according to claim 2 wherein the TBN is between 200 and 400.

4. A composition according to claim 2 wherein the overbased detergent mixture comprises sulphurised phenate.

5. A composition according to claim 2 in which the overbased detergent mixture comprises the reaction product of an alkali metal base or alkaline earth metal base with a phosphosulphurised hydrocarbon and an alkyl phenol or an alkyl phenol sulphide in the presence of a diluent oil, carbon dioxide being blown into the reaction mixture whilst the reaction occurs.

6. A composition according to claim 2 wherein the overbased detergent mixture comprises an overbased sulphonate.

7. A composition according to claim 1 wherein the overbased detergent mixture comprises an overbased naphthenate.

8. A composition according to claim 4 wherein the antioxidant comprises a sulphide.

9. A composition according to claim 5 wherein the antioxidant comprises a sulphide.

10. A composition according to claim 5 wherein the antioxidant comprises a zinc dialkyl dithiophosphate.

11. A composition according to claim 1 wherein the weight ratio of overbased detergent to antioxidant lies between 20:1 and 30:1.

12. A composition according to claim 2 wherein the overbased detergent mixture comprises more than 80 wt.% of Group IIa metal detergent and up to 20 wt.% of Group Ia detergent.

13. A composition according to claim 1 which comprises 75 to 85 parts by weight of lubricating oil, 15 to 25 parts by weight of overbased detergent mixture and 0.5 to 2.5 parts by weight of antioxidant.

* * * * *